United States Patent [19]

Wood

[11] 3,958,905

[45] May 25, 1976

[54] CENTRIFUGAL COMPRESSOR WITH INDEXED INDUCER SECTION AND PADS FOR DAMPING VIBRATIONS THEREIN

[75] Inventor: Homer J. Wood, Sherman Oaks, Calif.

[73] Assignee: Deere & Company, Moline, Ill.

[22] Filed: Jan. 27, 1975

[21] Appl. No.: 544,520

[52] U.S. Cl. ..... 416/183; 415/143; 416/132 R; 416/500; 415/DIG. 1

[51] Int. Cl.[2] ..... B64C 11/16

[58] Field of Search ..... 416/182, 183, 500, 132, 416/190, 140; 415/DIG. 1, 143, 74

[56] References Cited

UNITED STATES PATENTS

| | | | |
|---|---|---|---|
| 1,258,462 | 3/1918 | Rice | 416/183 |
| 2,405,283 | 8/1946 | Birmann | 416/183 |
| 2,664,240 | 12/1953 | Gorton | 416/500 |
| 2,859,933 | 11/1958 | Whitaker | 416/183 |
| 2,941,780 | 6/1960 | von Der Nuell et al. | 416/500 |
| 3,627,447 | 12/1971 | Okapuu | 416/183 |
| R27,038 | 1/1971 | Newland | 416/183 |

FOREIGN PATENTS OR APPLICATIONS

| | | | |
|---|---|---|---|
| 761,187 | 11/1956 | United Kingdom | 416/183 |
| 179,414 | 4/1966 | U.S.S.R. | 416/183 |
| 479,427 | 1/1938 | United Kingdom | 415/DIG. 1 |
| 668,093 | 3/1952 | United Kingdom | 416/500 |

*Primary Examiner*—Henry F. Raduazo
*Attorney, Agent, or Firm*—Fraser and Bogucki

[57] ABSTRACT

A centrifugal compressor assembly for a gas turbine engine includes an inducer section and an impeller section mounted for rotation about an axis. Because leading edges of the impeller blades are cambered, damper pads, extending perpendicular to the low pressure sides thereof also extend axially forward. Blades of the inducer section are indexed rotationally rearward of the impeller blades to improve the distribution of compression gases through the impeller section and high pressure surfaces of the inducer blades mate near their leading edges with outward surfaces of the damper pads. Because the pads and inducer blades vibrate at different frequencies, inducer blade vibrations that might otherwise cause fatigue are attenuated by contact with the damper pads. The damper pad arrangement thus permits the damping of vibrations in the inducer blades notwithstanding the indexed relationship between the inducer section and the impeller section.

12 Claims, 4 Drawing Figures

CENTRIFUGAL COMPRESSOR WITH INDEXED INDUCER SECTION AND PADS FOR DAMPING VIBRATIONS THEREIN

BACKGROUND OF THE INVENTION

1. Field of the Invention

This invention relates generally to compressors for gas turbine engines and more particularly to vibration damping in high pressure ratio centrifugal compressors of the type comprising an inducer section and an impeller section indexed relative thereto.

2. Description of the Prior Art

Gas turbine engines, and particularly engines for vehicular applications, place tremendous demands upon the compressor rotor. For example, rotational speeds of 60,000 to 70,000 rpm or more may be required in conjunction with single stage pressure ratios of up to 6:1 or more over a substantial range of rotational velocities. One arrangement which has been developed to meet these heavy demands is the two part centrifugal compressor comprising an inducer and an impeller. The velocity of the gas (typically air) relative to the blade is highest and often supersonic at the inducer inlet and the blades of the inducer section therefore have more of a disturbing effect on air flow than do the impeller blades. Inducer blades are thus made as thin as practical to minimize this disturbance. However, because of the levels of stress and vibrations to which the inducer blades are subjected during operation, there are practical limits on how thin these blades can be made. If they are made too thin, blade vibrations occur with sufficient amplitude to cause metal fatique and the blades fail under the stress of high velocity rotation.

SUMMARY OF THE INVENTION

A high speed, high pressure ratio, centrifugal compressor for a gas turbine engine in accordance with the invention includes an inducer section having blades extending substantially radially outward from a first hub, an impeller section having blades extending substantially radially outward from a second hub and damper pads secured to the blades extending substantially normal to the impeller on the low pressure side thereof for vibration-damping contact with the high pressure side of the inducer blades. Even though the inducer blades are indexed rotationally rearward of corresponding impeller blades for better air flow distribution, the damper pads extend across the short distance therebetween to make vibration damping contact with the inducer blades. The inducer blades can thus be made relatively thin to minimize disturbance of the low pressure, high velocity air flow while the damper pads, which have different resonant frequencies, suppress fatigue-causing vibrations which would otherwise cause the inducer blades to fail under the stress of high speed rotation.

In accordance with a specific, exemplary form of the invention, a compressor is provided having an inducer section with half the number of blades as the impeller section, every other impeller blade cooperating with one of the inducer blades in vibration-suppressing fashion. In this respect, a stream-lined damper pad projects from the low pressure face of each of the cooperating impeller blades. Although other radial positions are possible, in this example each damper pad is disposed at a corner of an impeller blade defined by an inlet edge and a blade tip. The corner of the high pressure face of the inducer blade at the junction of the tip and outlet edge thereof is maintained in extremely close proximity to, and may be in contact with, the damper pad whereby vibration of the inducer blade is effectively suppressed during operation.

The indexed or staggered relationship between the inducer and impeller blades has the advantageous effect of tending to equalize the flow through the various blade passages to improve the overall compressor efficiency. The high energy flow leaving the high pressure side of the inducer blade attaches to the low pressure side of the impeller blade. Each intermediate impeller blade having no damper pad receives a mixture of high energy and low energy air from the two adjacent high pressure and low pressure inducer blade sides respectively. This redistribution of the flow establishes new boundary layers on the impeller blades which delay flow separation on the low pressure side of the impeller blades and increases the compressor efficiency.

BRIEF DESCRIPTION OF THE DRAWINGS

A better understanding of the invention may be had from a consideration of the following detailed description taken in conjunction with the accompanying drawings, in which.

DETAILED DESCRIPTION

Figure 1:
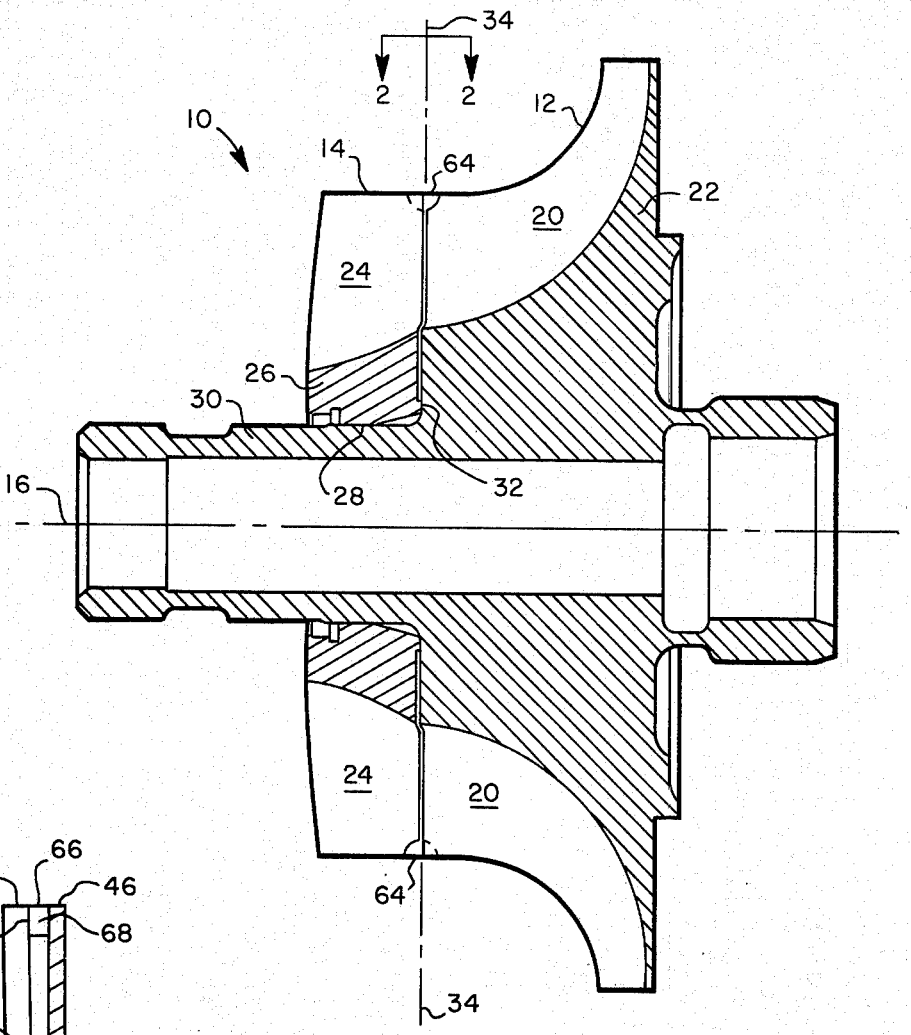
FIG. 1 is a typical meridional section view of a compressor rotor in accordance with the invention.

Referring to the drawings, a centrifugal compressor 10 is shown comprising an impeller section 12 and an entrance or inducer section 14 secured thereto. The compressor is rotatable within a shroud or casing (not shown) about a central axis 16.

The impeller 12 includes a number of blades 20 extending radially from a hub 22 and the inducer 14 has a series of blades 24 extending substantially radially from a hub 26. The inducer hub 26 has an axial bore 28 receiving a shaft 30 projecting forwardly from the impeller hub 22. The bore 28 and shaft 30 are dimensioned for an interference fit. An interface 32, lying on a radial plane 34, is defined by the hubs 22 and 26.

Although the number of inducer blades 24 may be equal to the number of impeller blades 20, in the specific embodiment under discussion the inducer has half the number of blades of the impeller, each inducer blade 24 cooperating with an alternate impeller blade 20*a* in a manner to be described.

Figure 2:
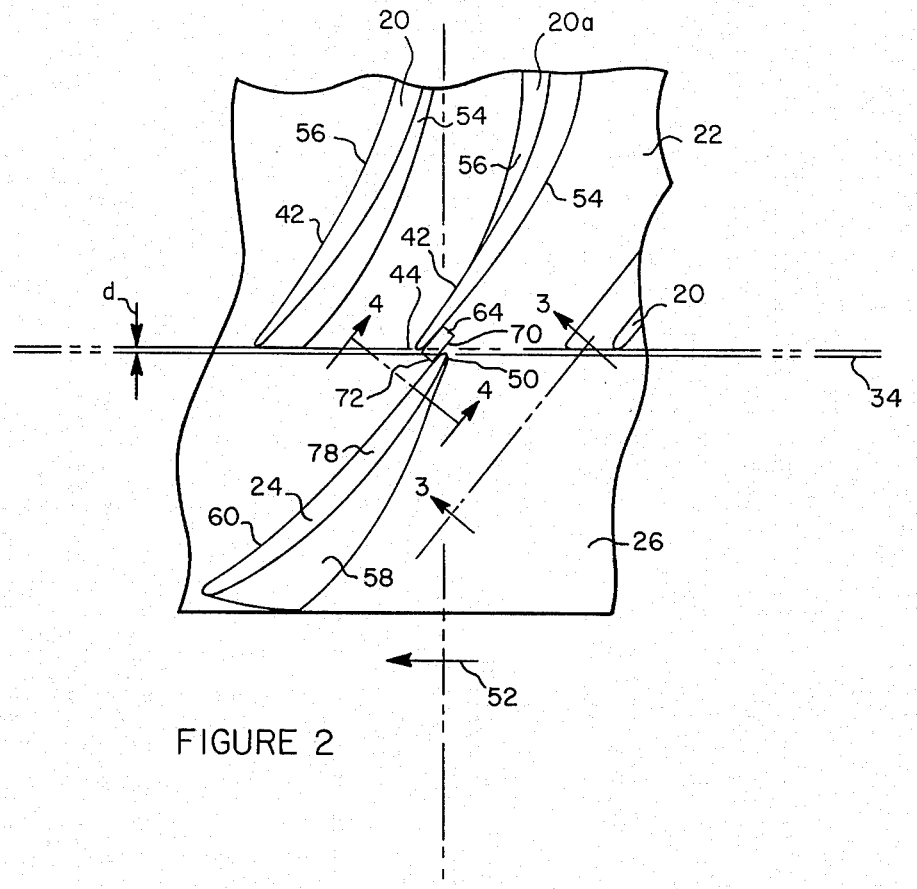
FIG. 2 is a top view of a portion of the compressor of FIG. 1, as seen along 2—2, showing certain details of the inducer and impeller blades.
Figure 3:
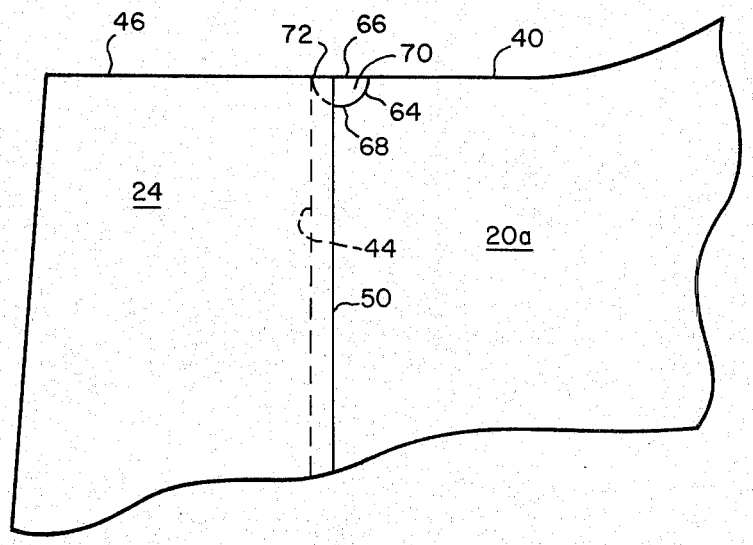
FIG. 3 is a side elevation view of a portion of the compressor of the invention, as seen along 3—3 in FIG. 2.
Figure 2:
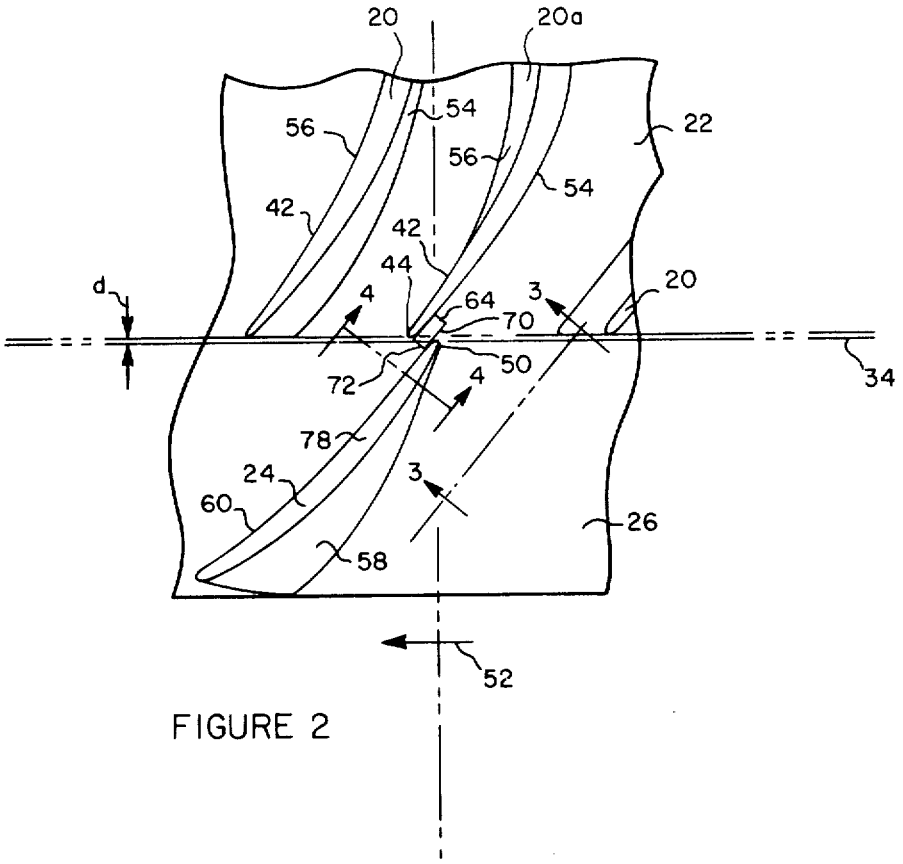
Figure 4:
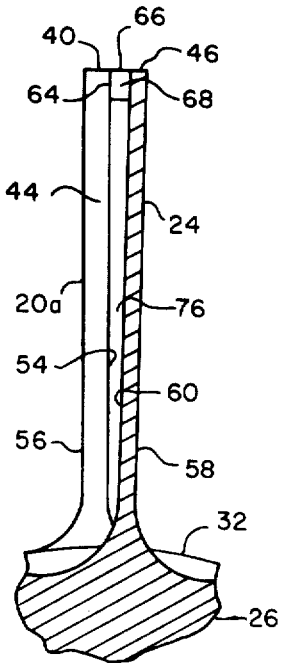

Each impeller blade 20 has an outer edge or tip 40 and an inlet portion 42 including a radially extending inlet or leading edge 44. Each inducer blade 24 has a tip 46 and an outlet portion 48 terminating along a radially extending outlet edge 50. Both the inducer blades 24 and the inlet portions 42 of the impeller blades are cambered or curved forwardly, that is, in the direction of rotation indicated by the arrow 52 (FIG. 2).

Each impeller blade 20 has a low pressure (suction) surface 54 and a high pressure surface 56; likewise, the inducer blades 24 each have a low pressure (suction) surface 58 and a high pressure surface 60.

Projecting from the low pressure surface of each impeller blade 20*a*, adjacent the corner thereof defined by the inlet edge 44 and the tip 40 is a streamlined damping pad 64. The pad 64 may take the shape of a half cylinder, as shown, having a radially outward, planar surface 66 flush with the impeller blade tip 40, a radially inward, arcuate surface 68 and a semi-circular planar surface, or cheek 70. The pad 64 is positioned so that its leading edge 72 is in alignment with the inlet edge 44 of the impeller blade 20*a*. It will be appreciated that the damper pad is not limited to any specific shape. Any curved shape which minimizes interference with the air flow through the compressor may be employed. Further, the damper pad 64 may be fabricated as an integral part of the blade 20*a* or, alternatively, may comprise a separate element suitably secured to the blade 20*a* by welding or other bonding or fastening process. While located at the blade tips in this example, in general the radial position of the pads 64 should be selected for maximum vibrational attenuation and minimal disturbance of the gas flow.

Since the air density is greater adjacent the high pressure face 56 of the impeller blades, placement of the damper pads 64 on the low pressure sides of the impeller blades tends to cause the least interference with the air flow through the impeller section.

The corner of the high pressure face 60 of the inducer blade 24 immediately adjacent the junction of the tip 46 and outlet edge 50 of the inducer blade engages the forwardmost portion of the pad cheek 70. During assembly of the inducer and impeller sections, the blades 20*a* and 24 of the two sections are so oriented relative to each other that the inducer blades are in extremely close proximity to the damper pads. The damper pads may or may not contact the adjacent inducer blades, but they are sufficiently close to prevent even small amplitude vibrations.

As best seen in FIG. 2, the outlet edges 50 of the inducer blades 24 lie in the plane 34 of the hub interface 32 while the inlet edges 44 of the impeller blades 20 are set back a small distance *d* (0.005 inch in accordance with one practical example) from that plane. The result is that only a very small area of each inducer blade 24 is in contact with the corresponding damper pad 64. Such a small area of contact is all that is required to effect the necessary vibrationsuppressing action.

The described arrangement permits the somewhat more stable impeller blades 20 to support the damper pads 64 with adequate mechanical strength. Notwithstanding the indexed relationship of the inducer and impeller blades, the inducer blades 24 still receive the advantage of vibration amplitude limiting contact with the pads 64 without having to support the mass of the pads. Large magnitude vibrations are easily established in the inducer blades at resonant frequencies during normal operation in the severe environment of a gas turbine engine. Unless suppressed by the damper pads 64, these resonant vibrations would cause fatigue of the inducer blades leading to their early failure.

It has been found that the rotationally rearward staggering or indexing of the inducer blades 24 relative to the impeller blades 20 (best seen in FIG. 4) improves the aerodynamic characteristics of the compressor. The indexing angle is preferably about 1°–3° and is less than half the angle between adjacent pairs of inducer blades. Advantage is taken of the tendency of the air to attain a higher density adjacent the high pressure surfaces of the inducer blades to more uniformly distribute the air flow through the various blade passages defined by the impeller blades. The narrow openings 76 between the high pressure side 60 of the inducer blades and the low pressure side 54 of the impeller blades 20*a* cause an increased air flow rate along the low pressure sides of the impeller blades thus tending to equalize the air flow across the blade passages. This improved flow distribution delays flow separation on the low pressure sides of the impeller blades. The improved flow equalization and delayed boundary layer separation made possible by this invention thus tends to improve the efficiency of the compressor.

While there has been shown and described above a particular arrangement of a centrifugal compressor for a gas turbine engine in accordance with the invention, it will be appreciated that the invention is not limited thereto. Accordingly, any modifications, variations or equivalent arrangements within the scope of the appended claims should be considered to be within the scope of the invention.

What is claimed is:

1. A centrifugal compressor for a gas turbine engine comprising:

an impeller including a plurality of impeller blades, each of said blades having an inlet edge and a low pressure face;

a plurality of damper pads each projecting from the low pressure face of an impeller blade adjacent the inlet edge; and an inducer coupled to the impeller for rotation therewith and including a plurality of inducer blades each being indexed relative to a corresponding impeller blade and each having an outlet edge and a high pressure face, a portion of the high pressure face of each inducer blade adjacent the outlet edge of the inducer blade engaging the damper pad on a corresponding impeller blade without being secured thereto.

2. A centrifugal compressor, as defined in claim 1, in which each impeller blade has an inlet portion including the inlet edge and in which the inducer blades and the impeller blade inlet portions are cambered.

3. A centrifugal compressor, as defined in claim 1, in which the damper pads are shaped to minimize disturbance of air flow through the compressor.

4. A centrifugal compressor as defined in claim 1, in which inducer blades are indexed rotationally rearward relative to corresponding impeller blades, the indexing angle being less than half the angle between adjacent inducer blades.

5. A centrifugal compressor comprising an inducer section and an impeller section mounted for rotation as a unit about a common central axis, the sections being coaxially disposed in abutting relation, each section including a hub and a plurality of blades extending therefrom, the impeller blades having inlet edges and the inducer blades having outlet edges, the impeller blades being rotationally staggered relative to the inducer blades about the axis forming pairs of adjacent impeller and inducer blades, the outlet edge of each inducer blade defining an opening with the inlet edge of an adjacent impeller blade, and a vibration amplitude limiting means projecting from the impeller blade across the opening and engaging the adjacent inducer blade without being secured thereto to limit vibration therein.

6. A centrifugal compressor, as defined in claim 5, in which the impeller blades and inducer blades are cambered.

7. A centrifugal compressor, as defined in claim 6, in which the outlet edges of the inducer blades and the inlet edges of the impeller blades lie approximately along a common, radial plane.

8. A centrifugal compressor, as defined in claim 5, in which the vibration amplitude means is shaped and positioned to minimize disturbance of fluid flow through the compressor.

9. A centrifugal compressor, as defined in claim 5 above, wherein the inducer and impeller blades are staggered to equalize flow and delay flow separation on low pressure surfaces of the impeller blades.

10. In a centrifugal compressor having a bladed impeller section and an inducer section with blades indexed relative to corresponding blades of the impeller section, a plurality of pads, each being affixed to an impeller blade near a leading edge thereof and extending into vibration suppressing contact with a corresponding blade of the inducer section.

11. The pads as set forth in claim 10 above, wherein each pad is approximately shaped as a half cylinder with a semicircular surface disposed adjacent an inducer blade surface which is substantially parallel thereto.

12. The centrifugal compressor as defined in claim 1, wherein each damper pad is supported solely by an impeller blade at a radially outward extremity of the inlet edge thereof.

* * * * *

UNITED STATES PATENT OFFICE

CERTIFICATE OF CORRECTION

Patent No. 3,958,905 Dated May 25, 1976

Inventor(s) Homer J. Wood

Figure 4:
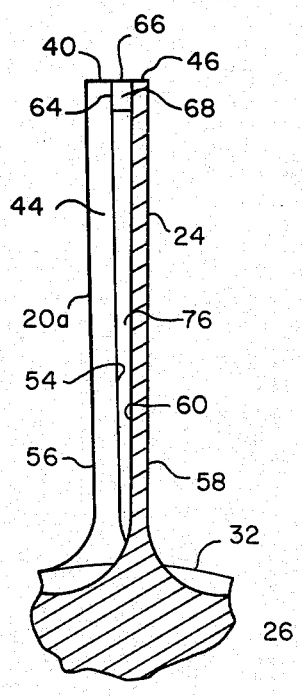
FIG. 4 is a cross-section view of a portion of the compressor of the invention, taken along 4—4 in FIG. 2.

It is certified that error appears in the above-identified patent and that said Letters Patent are hereby corrected as shown below:

In the drawings, Figures 2 and 4 should read as shown on the attached sheet.

Signed and Sealed this

Eighth Day of November 1977

[SEAL]

*Attest:*

RUTH C. MASON
*Attesting Officer*

LUTRELLE F. PARKER
*Acting Commissioner of Patents and Trademarks*